US005766306A

United States Patent [19]

Olli et al.

[11] Patent Number: 5,766,306

[45] Date of Patent: Jun. 16, 1998

[54] CONTINUOUS PROCESS FOR MAKING NANOSCALE AMORPHOUS MAGNETIC METALS

[75] Inventors: Larry K. Olli, Seattle; Patrice K. Ackerman, Kent; Robert J. Miller, Fall City; Diane C. Rawlings, Bellevue, all of Wash.

[73] Assignee: The Boeing Company, Seattle, Wash.

[21] Appl. No.: 657,992

[22] Filed: Jun. 4, 1996

[51] Int. Cl.[6] ..... B22F 9/18

[52] U.S. Cl. ..... 75/345; 75/348; 75/362

[58] Field of Search ..... 75/345, 347, 348, 75/362; 148/105

[56] References Cited

U.S. PATENT DOCUMENTS

| | | | |
|---|---|---|---|
| 3,986,901 | 10/1976 | Plante et al. | 148/105 |
| 5,456,986 | 10/1995 | Majetich et al. | 148/105 |
| 5,520,717 | 5/1996 | Miller et al. | 75/345 |

FOREIGN PATENT DOCUMENTS

93/05877 4/1993 WIPO .

OTHER PUBLICATIONS

K. Suslick; "Applications of Ultrasound to Materials Chemistry," MRS Bulletin; Apr., 1995; pp. 29–34.

J. Haggin; "Nanostructured Catalysts Prepared," 209th ACS National Meeting; Apr. 24, 1995; p. 47.

K. Suslick et al.; "Sonochemical Synthesis of Amorphous Iron," Nature, vol. 353; Oct. 3, 1991; pp.414–416.

I. Billas et al.; "Magnetism from the Atom to the Bulk in Iron, Cobalt, and Nickel Clusters," Science, vol. 265; Sep. 16, 1994; pp. 1682–1684.

C. Gibson et al.; "Synthesis and Characterization of Anisometric Cobalt Nanoclusters;" Science, vol. 267; Mar. 3, 1995; pp. 1338–1340.

L. Crum; "Sonoluminescence;" Physics Today; Sept., 1994; pp. 22–29.

K. Suslik; "The Chemistry of Ultrasound;" Yearbook of Science and the Future; Encyclopedia Britannica, Inc., 1994; pp. 140–155.

K. Suslick; "Sonochemistry;" Am. Assoc. for the Adv. of Sci., vol. 247; pp. 1439–1445, 23 Mar. 1990.

L. Crum; "Sonoluminescence, Sonochemistry, and Sonophysics;" J. Acoustical Soc. of Am.; vol. 95, No. 1, Jan. 1994, pp. 559–562.

*Primary Examiner*—George Wyszomierski
*Attorney, Agent, or Firm*—John C. Hammar

[57] ABSTRACT

Sononochemistry permits extremely rapid cooling to produce nanoscale particles. If magnetic, these particles are valuable for magnetic recording media, manufacture of permanent magnets, and other uses. In the present invention, we sonicate neat metal carbonyl to produce particles which we separate, generally magnetically, from the metal carbonyl, thereby making the production process as simple as possible and continuous.

6 Claims, 1 Drawing Sheet

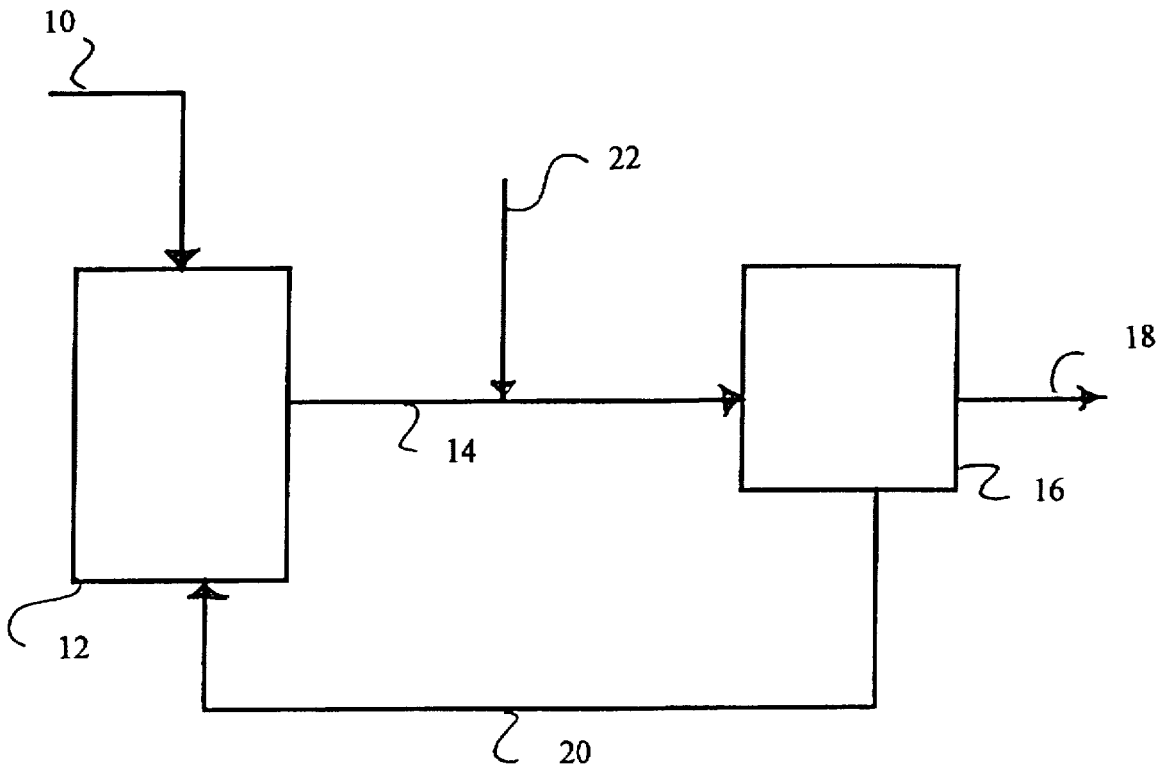
10
22
18
14
16
12
20

CONTINUOUS PROCESS FOR MAKING NANOSCALE AMORPHOUS MAGNETIC METALS

This invention was made with Government support under Contract 95-C-8057. The Government has certain rights in this invention.

TECHNICAL FIELD

The present invention relates to making nanoscale particles of amorphous magnetic metals using sonochemistry to produce the particles with continuous separation of the particles from the reactants.

BACKGROUND ART

Kenneth Suslick of the University of Illinois pioneered research into sonochemistry, a technique that uses the energy of sound to produce cavitation bubbles in a solvent. The bubbles collapse during the compression portion of the acoustic cycle with extreme microscale energy release evidenced by high (microscale) localized temperatures and pressures, estimated at about 5200° F. and 1800 atm, respectively. Suslick determined that sonochemistry was an effective way to produce amorphous metal particles. He developed laboratory processes for making amorphous iron agglomerates desired as catalysts in hydrocarbon reforming, carbon monoxide hydrogenation, and other reactions.

Suslick also discovered that he could produce metal colloids and supported catalysts if he sonicated the metal precursors (principally volatile metal carbonyls or other organometallics) with a suspended polymer like polyvinylpyrrolidone or with suspended inorganic oxide supports, such as silica or alumina.

Suslick's work focused on sonochemical techniques to form catalysts composed of agglomerated metal nanoparticles. These catalysts are very efficient because of their large surface areas. His work is described in the following articles that we incorporate by reference:

(1) K. Suslick, *"Sonochemistry"*, 247 Science 1439–1445 (23 Mar., 1990);

(2) K. Suslick et al, *"Sonochemical Synthesis of Amorphous Iron"*, 353 Nature 414–416 (3 Oct., 1991); and (3) K. Suslick, *"The Chemistry of Ultrasound,"* Yearbook of Science & the Future, Encyclopedia Britannica, Inc., 138–155 (1994).

Similar work is described in the following articles by Lawrence Crum, that we also incorporate by reference:

(1) L. Crum, "Sonoluminescence," Physics Today, September 1994, pp. 22–29, and (2) L. Crum *"Sonoluminescence, Sonochemistry, and Sonophysics"*, J. Acoust. Soc. Am. 95 (1), January 1994, pp. 559–562.

Gibson discussed anisometric cobalt nanoclusters in his article in Science (vol. 267; Mar. 3, 1995), where he produced anisometric (hexagonal disk-shaped) cobalt nanoclusters about 100 nanometers in width and 15 nanometers in thickness with oriented (001) crystals comparable to cells of α-cobalt. Gibson sonicated $Co^{2+}$ (aq) with hydrazine to produce the nanoclusters that were small enough to be strongly influenced by Brownian forces and thereby resistant to agglomeration. Working with hydrazine, however, on a commercial scale poses safety questions.

In U.S. Pat. No. 5,520,717 and U.S. patent application Ser. No. 08/_ (which we incorporate by reference), we described a process to create "nanophase" or "nanoscale" amorphous metal particles with Suslick's sonochemistry techniques using organometallic precursors like iron pentacarbonyl ($Fe(CO)_5$) in an alkane (like n-heptane or n-decane) under an inert atmosphere with sonication at about 20 kHz and 40–100 Watts for 0.1–24 hours. Thereafter, we extracted the particles (distributed in the range of about 5–100 nm in diameter) from the alkane using a polar solvent of reasonably high vapor pressure such as ethylene glycol monomethyl ether ($CH_3O—CH_2CH_2—OH$). Then, we added a polymer or polymeric precursors (especially those of vinylpyrrolidone, an acrylic, or a urethane) with or without surfactants to coat and separate the metal particles.

We have discovered in the present invention that we can convert our process from batch operation to continuous processing while eliminating the hydrocarbon reaction solution and the extraction solvent.

SUMMARY OF THE INVENTION

To produce individual or agglomerated metal particles in the particle size distribution range of 10–30 nm with sonochemistry, we have developed a continuous process involving the steps of:

(a) feeding neat metal carbonyl, like iron pentacarbonyl, to a reactor;

(b) sonicating the neat metal carbonyl to produce nanoscale particles; and (c) separating the particles from the iron pentacarbonyl, preferably in a magnetic separator.

Generally, our preferred process produces particles that are essentially all about 30 nm in diameter. Typically the particles are iron or iron alloys.

We eliminate the hydrocarbon reaction solution (an alkane or water) that others suggest and, thereby, greatly simplify the process. We discovered that using the hydrocarbon impaired the continuous preparation of the particles when we attempted larger reaction quantities and tried to replenish the reactants, although we do not understand why the production rate declined when a hydrocarbon medium was used in addition to the organometallic precurson (i.e. $Fe(CO)_5$).

To avoid undue agglomeration and to produce finer particles smaller than 30 nm in diameter, we generally introduce a surfactant prior to separation of the particles.

Finally we can reconstitute the agglomerated particles into a large individual particle by microwave processing to rapidly heat the iron to the melt with its subsequent resolidification into a unitary nanophase particle.

DESCRIPTION OF THE DRAWING

The FIGURE is a block diagram, illustrating the continuous process of the present invention.

DETAILED DESCRIPTION OF A PREFERRED EMBODIMENT

By "nanoscale particles," we mean particles (typically spheres) of no more than about 600 nanometers (nm) in diameter. The particles are usually in the particle size range of 50–100 nm, and, generally, are about 5–100 nm in diameter. Preferably, we form particles whose diameters range from about 1–50 nm, and, most preferably, 5–30 nm with our target being particles of 30 nm diameter.

The present invention is a simple, safe, continuous, sonochemistry process for producing nanoscale, magnetic, amorphous metal particles, especially iron, from organometallic precursors, like $Fe(CO)_5$. These particles are useful in magnetic recording media and other coatings responsive to incident radiation. Particle size is important in these applications as well as control of the particle size distribution within a narrow range reproducible from batch to batch.

We add neat iron pentacarbonyl 10 (i.e., 100% reagent grade material) or another suitable organometallic precursor or a mixture of these organometallics to a reactor 12 under an inert (argon) atmosphere. Generally we follow the process descriptions of Suslick and Gibson in other respects, inputting sonic energy to the reaction mixture at about 20 kHz and 40–100 Watts. The reactor is sized so that the iron pentacarbonyl has a reactor residence time of about 1 minute to about 24 hours, generally about 1–360 minutes, and, preferably, about 1–20 minutes. We produce iron particles in the 5–30 nm size range and clusters of agglomerated particles in this size range at a rate of about $6.8\times10^{-4}$ g/hr-ml organometallic precursor. We draw off a portion of the reaction mixture from the reactor 12 through line 14 and separate the particles from the unreacted iron carbonyl in a magnetic separator 16. The nanoscale particles 18 are our product, while the unreacted iron pentacarbonyl is recycled to the reactor through line 20

We control further agglomeration during the separating stage by adding surfactant or dispersant 22 to each aliquot withdrawn from the reactor, making sure that we do not introduce excess surfactant. Suitable dispersants include the sodium salt of bis(2-ethylhexyl)sulfosuccinic acid, which is available from Fischer Scientific. Disperseants can impart a charge to the particle surfaces such that repulsive forces exist between particles. Suitable chemicals include polyvinylpyrolidone, ammonium and sodium polyelectrolytes such as Daxad 37LN10 (available from R. W. Grace Co., Lexington, Mass.), deflocculants from the Dispex family (Allied Colloids, Yorkshire, England) and Darvan C (RT Vanderbilt, Norwalk, Conn.) and various lignosulfonates. We add surfactant in an amount which is effective for achieving the desired degree of dispersion. Although the amount required varies depending on selected chemical and the characteristics of the particles typically on the order of 5–100 parts per million parts solution by volume are required. Some surfactants might be removable by thermal treatment in later processing of the recovered particles.

We can convert agglomerated nanoscale clusters of several particles to a single, large particle using microwave energy to heat the iron rapidly to the melt followed by resolidification. We pulse the microwave energy in the reactor or in the separator. Our preferred duty cycle involves relatively short cycles of radiation. The metal particles are strong absorbers. The particles melt while the liquid remains relatively cool (approaching 100°–300° C.). The calculated particle heating rates are as high as 60° C. per second. Measured heating of mineral oil with 1% iron nanoscale particles by weight produced a liquid temperature of about 250° C. after 100 seconds using a commercial microwave oven. We expect that the optimal heating cycle will take less than 100 seconds. A possible duty cycle for the for the microwave resolidification step is described in U.S. Pat. No. 5,462,009 by Garrigus where he sintered $LaMnO_3$-type ceramics in a similar process.

The separator typically is of the magnetic type since the iron particles are highly permeable while the iron carbonyl is not. Therefore, in a magnetic field the particles will migrate readily to the poles for easy removal from the iron carbonyl. While we prefer magnetic separation, we can use any technique suitable for separation of nanophase particles, such as microfiltration or solvent extraction. Magnetic separation is the easiest, especially with the relatively small volumes and flowrates common for this process. Magnetic separation also reduces contamination of the unreacted organometallic reactant and produces the highest yields without the need for additional cleaning stages or purging of the organometallic.

While we have described preferred embodiments, those skilled in the art will recognize modifications, alternatives, or variations that might be made without departing from the inventive concept. Therefore, limit the claims only as necessary in view of the pertinent prior art.

We claim:

1. A continuous method of making nanoscale, metal particles in a reactor comprising the steps of:

(a) sonicating neat metal carbonyl in a reactor under an inert atmosphere to produce an amorphous metal in the form of generally spherical, nanoscale particles about 5–30 nm in diameter;

(b) adding a surfactant to the reactor in an amount effective to isolate the metal particles from one another during a subsequent separating step; and, (c) magnetically separating the metal particles from the metal carbonyl in a separator.

2. The method of claim 1 wherein the metal carbonyl includes $Fe(CO)_5$.

3. The method of claim 2 wherein the sonicating step involves 20 kHz at 40–100 Watts for a reactor residence time of about 1–20 minutes, and further comprising the step of recycling unreacted carbonyl to the reactor.

4. The method of claim 1 further comprising the step of microwaving the metal particles to heat rapidly and melt the particles and then resolidifying into a single larger particle.

5. The method of claim 4 wherein the metal carbonyl includes $Fe(CO)_5$ so that the metal particles are iron or an iron alloy.

6. The method of claim 1 wherein the metal carbonyl includes $Fe(CO)_5$ so that the metal particles are iron or an iron alloy.

* * * * *